US010141173B2

(12) United States Patent
Syage

(10) Patent No.: US 10,141,173 B2
(45) Date of Patent: Nov. 27, 2018

(54) SYSTEMS FOR SEPARATING IONS AND NEUTRALS AND METHODS OF OPERATING THE SAME

(71) Applicant: MORPHO DETECTION, LLC, Newark, CA (US)

(72) Inventor: Jack A. Syage, Corona del Mar, CA (US)

(73) Assignee: Rapiscan Systems, Inc., Torrance, CA (US)

( * ) Notice: Subject to any disclaimer, the term of this patent is extended or adjusted under 35 U.S.C. 154(b) by 0 days.

(21) Appl. No.: 15/386,684

(22) Filed: Dec. 21, 2016

(65) Prior Publication Data

US 2017/0103880 A1 Apr. 13, 2017

Related U.S. Application Data

(62) Division of application No. 14/564,746, filed on Dec. 9, 2014, now Pat. No. 9,558,924.

(51) Int. Cl.
*H01J 49/24* (2006.01)
*H01J 49/04* (2006.01)
(Continued)

(52) U.S. Cl.
CPC ..... *H01J 49/24* (2013.01); *H01J 49/0022* (2013.01); *H01J 49/0031* (2013.01);
(Continued)

(58) Field of Classification Search
CPC ..... H01J 49/0022; H01J 49/0031; H01J 49/0409; H01J 49/0495; H01J 49/24; H01J 49/40; H01J 49/162
See application file for complete search history.

(56) References Cited

U.S. PATENT DOCUMENTS 4,818,862 A 4/1989 Conzemius
4,894,536 A * 1/1990 Conzemius ..... H01J 49/004 250/282
(Continued)

FOREIGN PATENT DOCUMENTS

CN 103311087 A 9/2013
JP 10302709 A 11/1998
WO 2009023361 A2 2/2009

OTHER PUBLICATIONS

Mo Yang et al., "Development of a Palm Portable Mass Spectrometer," American Society for Mass Spectrometry,vol. 19, No. 10, pp. 1442-1448, 2008.
(Continued)

*Primary Examiner* — Wyatt Stoffa
(74) *Attorney, Agent, or Firm* — Novel IP

(57) ABSTRACT

A mass spectrometer system includes a sample injection device defining a sample injection aperture. The system also includes an ion trap defining an ion outlet aperture. The ion trap is coupled to the sample injection device. The system further includes a detector positioned downstream of the ion outlet aperture. The system also includes an ion source coupled to the ion trap. The ion source is configured to ionize a sample injected into the ion trap and generate a plurality of ionized molecules within the ion trap. The ion trap is configured to maintain the plurality of ionized molecules therein while a plurality of neutral molecules migrate out of the ion trap until a predetermined pressure is attained in the ion trap.

15 Claims, 14 Drawing Sheets

(51) Int. Cl.
*H01J 49/40* (2006.01)
*H01J 49/00* (2006.01)
*H01J 49/16* (2006.01)

(52) U.S. Cl.
CPC ..... *H01J 49/0495* (2013.01); *H01J 49/162* (2013.01); *H01J 49/40* (2013.01)

(56) References Cited

U.S. PATENT DOCUMENTS 5,426,301 A * 6/1995 Turner ..... H01J 49/061 250/281
5,672,868 A 9/1997 Mordehai et al.
6,124,592 A * 9/2000 Spangler ..... H01J 49/4295 250/282
RE39,627 E 5/2007 Tanner et al.
7,247,847 B2 * 7/2007 Webb ..... H01J 49/34 250/281
7,399,959 B2 7/2008 Miller et al.
7,514,676 B1 4/2009 Page et al.
7,605,367 B2 10/2009 Miller et al.
7,902,498 B2 3/2011 Miller et al.
8,692,188 B2 4/2014 Webb
8,764,413 B2 * 7/2014 Stones ..... F04D 19/042 417/203
8,766,178 B2 7/2014 Ouyang et al.
2001/0030284 A1 * 10/2001 Dresch ..... H01J 49/401 250/287
2002/0125420 A1 * 9/2002 Park ..... H01J 49/061 250/281
2004/0089799 A1 5/2004 Kawato et al.
2004/0245452 A1 * 12/2004 Bateman ..... G01N 27/622 250/287
2004/0245455 A1 12/2004 Reinhold
2005/0009172 A1 * 1/2005 Yamakoshi ..... H01J 49/162 435/287.2
2005/0269508 A1 * 12/2005 Lippa ..... H01J 49/0054 250/292
2006/0016976 A1 * 1/2006 Land ..... H01J 49/40 250/282
2006/0016983 A1 * 1/2006 Kobayashi ..... H01J 49/0495 250/288
2006/0138317 A1 * 6/2006 Schultz ..... H01J 49/0031 250/287
2007/0187585 A1 * 8/2007 Verentchikov ..... H01J 49/004 250/287
2008/0272289 A1 * 11/2008 Vestal ..... H01J 49/025 250/287
2009/0101810 A1 * 4/2009 McLean ..... B82Y 30/00 250/282
2009/0194686 A1 * 8/2009 Guna ..... H01J 49/005 250/283
2011/0049352 A1 * 3/2011 Ding ..... H01J 49/0463 250/282
2012/0112061 A1 5/2012 Morokuma et al.
2012/0261570 A1 * 10/2012 Shvartsburg ..... H01J 49/0018 250/287
2014/0008530 A1 * 1/2014 Whitehouse ..... H01J 49/063 250/287
2015/0129761 A1 * 5/2015 Johnson ..... G01N 21/31 250/282
2015/0303043 A1 * 10/2015 Osgood ..... C07B 63/00 250/282

OTHER PUBLICATIONS

Partial European Search Report, dated Apr. 20, 2016, for copending EP patent application No. EP 15003417.1 (8 pages).
Extended European Search Report, dated Aug. 26, 2016, for copending EP patent application No. EP 15003417.1 (18 pages).

* cited by examiner

460

| | SECOND CHAMBER 110 | ION GUIDE 328 | ION GUIDE 329 | TOTAL |
|---|---|---|---|---|
| Neutral travel (cm) | 5 | 10 | 25 | 40 |
| Ion travel (cm) | 3 | 5 | 18 | 26 |
| Neutral velocity (cm/s) | $6.31*10^4$ | $6.31*10^4$ | $6.31*10^4$ | |
| Ion velocity (cm/s) | | | | |
| m=400 | $1.55*10^5$ | $1.55*10^5$ | $1.55*10^5$ | |
| m=40 | $4.91*10^5$ | $4.91*10^5$ | $4.91*10^5$ | |
| Neutral time (ms) | 0.079 | 0.158 | 0.396 | **0.633** |
| Ion time (ms) | | | | |
| m=400 | 0.019 | 0.032 | 0.116 | **0.168** |
| m=40 | 0.006 | 0.010 | 0.037 | **0.053** |

FIG. 6

470

| | SECOND CHAMBER 110 | FIRST ION REFLECTOR 128 | TOFMS DETECTOR 126 | TOTAL |
|---|---|---|---|---|
| Neutral travel (cm) | 5 | 5 | 25 | 35 |
| Ion travel (cm) | 3 | 2 | 45 | 50 |
| Neutral velocity (cm/s) | $6.31*10^4$ | $6.31*10^4$ | $6.31*10^4$ | |
| Ion velocity (cm/s) | | | | |
| m=400 | $1.55*10^5$ | $9.82*10^4$ | $2.19*10^6$ | |
| m=40 | $4.91*10^5$ | $3.10*10^5$ | $6.94*10^6$ | |
| Neutral time (ms) | 0.079 | 0.079 | 0.396 | **0.544** |
| Ion time (ms) | | | | |
| m=400 | 0.019 | 0.020 | 0.021 | **0.060** |
| m=40 | 0.006 | 0.006 | 0.006 | **0.019** |

FIG. 7

500

| | | |
|---|---|---|
| $S_1$ | 12 | L/s = $cm^3$/ms |
| | | |
| $C_{12a}$ | 5 | L/s |
| $C_{12b}$ | 0.5 | L/s |
| | | |
| $V_1$ | 100 | $cm^3$ |
| $V_2$ | 50 | $cm^3$ |
| | | |
| rep rate | 20 | Hz |
| $P_0$ base | 0 | mTorr |
| | | |
| throughput/pulse | 0.010 | atm-$cm^3$ |
| throughput | 0.198 | atm-$cm^3$/s |
| | 0.151 | mTorr-$cm^3$/ms |

FIG. 8

720

| | | |
|---|---|---|
| $S_0$ | 15 | L/s = $cm^3$/ms |
| $S_2$ | 40 | L/s |
| $C_{01}$ | 5 | L/s |
| $C_{12}$ | 0.5 | L/s |
| $V_0$ | 500 | $cm^3$ |
| $V_1$ | 1 | $cm^3$ |
| $V_2$ | 200 | $cm^3$ |
| throughput | 5 | atm-$cm^3$/min |
| rep rate | 60 | Hz |
| $P_0$ base | 0.18 | mTorr |

FIG. 11

770

| Region | Peak | Avg. | Low |
|---|---|---|---|
| | (mTorr) | | |
| Ion Trap Cavity 616 | 588.000 | 32.700 | 0.180 |
| TOF Chamber 640 | 0.400 | 0.136 | 0.021 |

FIG. 14

SYSTEMS FOR SEPARATING IONS AND NEUTRALS AND METHODS OF OPERATING THE SAME

CROSS-REFERENCE TO RELATED APPLICATIONS

This application is a divisional and claims priority to U.S. patent application Ser. No. 14/564,746, filed Dec. 9, 2014 for "SYSTEMS FOR SEPARATING IONS AND NEUTRALS AND METHODS OF OPERATING THE SAME", which is hereby incorporated by reference in its entirety and is assigned to the assignee of the present invention.

BACKGROUND

The embodiments described herein relate generally to a mass spectrometer (MS) systems that employ molecular ionization and, more particularly, to MS systems that separate ionized molecules from neutral molecules such that the two groups of molecules arrive at a detector at different times.

Most known mass spectrometer (MS) systems are typically used to detect one or more trace molecules of materials of interest from a sample. For example, a MS system may be used to detect the existence of toxic or otherwise dangerous compounds in a room. MS systems are also used to analyze drug compounds in solvents. Many known MS systems ionize trace molecules from a gas sample and then deflect the ionized molecules into a detector. The detector may detect the mass of the ionized molecule by measuring the time required for the molecule to travel across a chamber or by other means. The identity of the molecule can then be determined from the mass and the charge on the ionized molecules, i.e., the mass-to-charge ratio (m/z) is used to identify the chemical constituency of the ionized molecules.

In most known MS systems, the ratio of the number of neutral molecules to ionized molecules is on the order of magnitude of 1010 to 1. The transmission of neutral molecules to the detector increases the level of interference detections, i.e., "noise" processed by the detector, thereby inhibiting operation of the MS system. Therefore, many known MS systems include mechanisms to decrease the number of neutral molecules that reach the detector. However, most of these known mechanisms increase the size, weight, complexity, and cost of the associated MS systems.

For example, since most known MS systems operate at less than atmospheric pressure, vacuum pumps are used to maintain the low pressures in the MS systems. Exceeding low pressure parameters may decrease the service life of the associated MS systems. Transmission of the ionized molecules to the detector includes generating a pressure wave that includes the ionized molecules as well as a large number of neutral molecules. The vacuum pumps are used to remove at least a portion of the neutral molecules in the pressure wave while maintaining the pressure within the MS system below the pressure parameters. However, to remove a sufficient number of neutral molecules, the vacuum pumps needed are large, thereby decreasing the portability of the MS systems while increasing the size, weight, and cost. This issue is amplified in those known MS systems that include multiple vacuum chambers, each chamber with a dedicated vacuum pump, such a configuration often referred to as a differential pumping configuration.

Some known MS systems include apparatus to deflect the ionized particles away from the neutral particles. However, removal of the neutral particles from the vacuum space requires sufficiently large vacuum pumps, thereby frustrating efforts to decrease the size, weight, and cost of the MS systems. Therefore, simply decreasing the size of the vacuum pumps decreases the neutral molecules removed, thereby necessitating a decrease in the size of the sample that will be ionized and transmitted to the detector, thereby decreasing the sensitivity of the MS system with respect to the detection of the materials of interest.

BRIEF DESCRIPTION

In one aspect, a mass spectrometer system is provided. The system includes a sample injection device defining a sample injection aperture. The system also includes an ion trap defining an ion outlet aperture. The ion trap is coupled to the sample injection device. The system further includes a detector positioned downstream of the ion outlet aperture. The system also includes an ion source coupled to the ion trap. The ion source is configured to ionize a sample injected into the ion trap such that a plurality of ionized molecules is generated within the ion trap. The ion trap is configured to maintain the plurality of ionized molecules therein while a plurality of neutral molecules migrate out of the ion trap until a predetermined pressure is attained in the ion trap.

In another aspect, a method of operating a mass spectrometer system is provided. The method includes channeling a sample into an ion trap and ionizing at least a portion of the sample, thereby generating a plurality of ionized molecules within the ion trap. The method also includes maintaining the plurality of ionized molecules within the ion trap while a plurality of neutral molecules migrate out of the ion trap until a predetermined pressure is attained in the ion trap. The method further includes transmitting at least a portion of the plurality of ionized molecules from the ion trap into a detector chamber through an ion aperture.

DRAWINGS

FIGS. 1-14 show exemplary embodiments of the systems and methods described herein.

FIG. 1 is a schematic view of an exemplary time-of-flight mass spectrometry (TOFMS) system;

FIG. 2 is a schematic view of an alternative time-of-flight mass spectrometry (TOFMS) system with an ion mobility spectrometry (IMS) device;

FIG. 3 is a schematic view of an exemplary quadrupole mass spectrometry (QMS) system with an IMS device;

FIG. 4 is a graphical view of a calculated initial distribution in time and space of neutral molecules and ionized molecules after they are transmitted substantially simultaneously within the QMS system shown in FIG. 3;

FIG. 5 is a graphical view of typical molecule profiles showing calculated ion and neutral pulse trajectories as a function of time in the QMS system shown in FIG. 3;

FIG. 6 is a tabular view of calculated spatial and temporal properties for ionized molecules and neutral molecules for the QMS system shown in FIG. 3;

FIG. 7 is a tabular view of calculated spatial and temporal properties for ionized molecules and neutral molecules for the TOFMS systems shown in FIGS. 1 and 2;

FIG. 8 is a tabular view of assumptions used to determine spatial and temporal properties for ionized molecules and neutral molecules for the MS systems shown in FIGS. 1, 2, and 3 with a two-chamber vacuum system;

FIG. 9 is a graphical view of pressure transients in a plurality of different vacuum chambers of the MS systems shown in FIGS. 1, 2, and 3 with a two-chamber vacuum system and using the assumptions shown in FIG. 8;

FIG. 10 is a schematic view of an exemplary quadrupole ion trap, time-of-flight (QIT-TOF) MS system;

FIG. 11 is a tabular view of assumptions used to determine spatial and temporal properties for ionized molecules and neutral molecules for the QIT-TOF MS system shown in FIG. 10 with a two-chamber vacuum system;

FIG. 12 is a graphical view of pressure transients in a plurality of different vacuum chambers of the QIT-TOF MS system shown in FIG. 10 with a two-chamber vacuum system and using the assumptions shown in FIG. 11;

FIG. 13 is a graphical view of a pressure transient in an ion trap region of the QIT-TOF MS system shown in FIG. 10 and the associated waveforms generated; and FIG. 14 is a tabular view of pressures calculated for the QIT-TOF MS system shown in FIG. 10 during a single pulsed sample and analysis cycle.

DETAILED DESCRIPTION

The mass spectrometer (MS) systems described herein enhance detection of materials of interest while reducing the magnitude of the pumping requirements, thereby facilitating decreasing the size, weight, complexity, and costs of MS systems. Specifically, in one embodiment described herein, the associated MS system facilitates separating pulsed pressure waves into two separate components, i.e., a neutral wave including substantially neutral molecules and ionized molecules. The ionized molecules and the neutral wave are routed through the MS system such that they arrive at the associated detector at different times. As such, the sensitivity of the detectors to the ionized molecules is enhanced, while the detectors are turned off during the arrival of the neutral wave, thereby extending the service life of the detector. Also, specifically, in another embodiment described herein, a pulsed sample is ionized and the ions are trapped while the neutral pressure wave is allowed to decay through the use of the vacuum pumps such that when released from the ion trap, the pulsed ionized molecules are transmitted to the associated detector within the low pressure parameters with a significantly smaller neutral molecule population than would otherwise be transmitted. Additionally, since the significance of the neutral molecules is decreased by temporal and/or physical separation from the ionized molecules, the vacuum pumps associated with the MS systems described herein are decreased in number and size from those of known MS systems while maintaining the pressures in the systems within established parameters.

Figure 1:
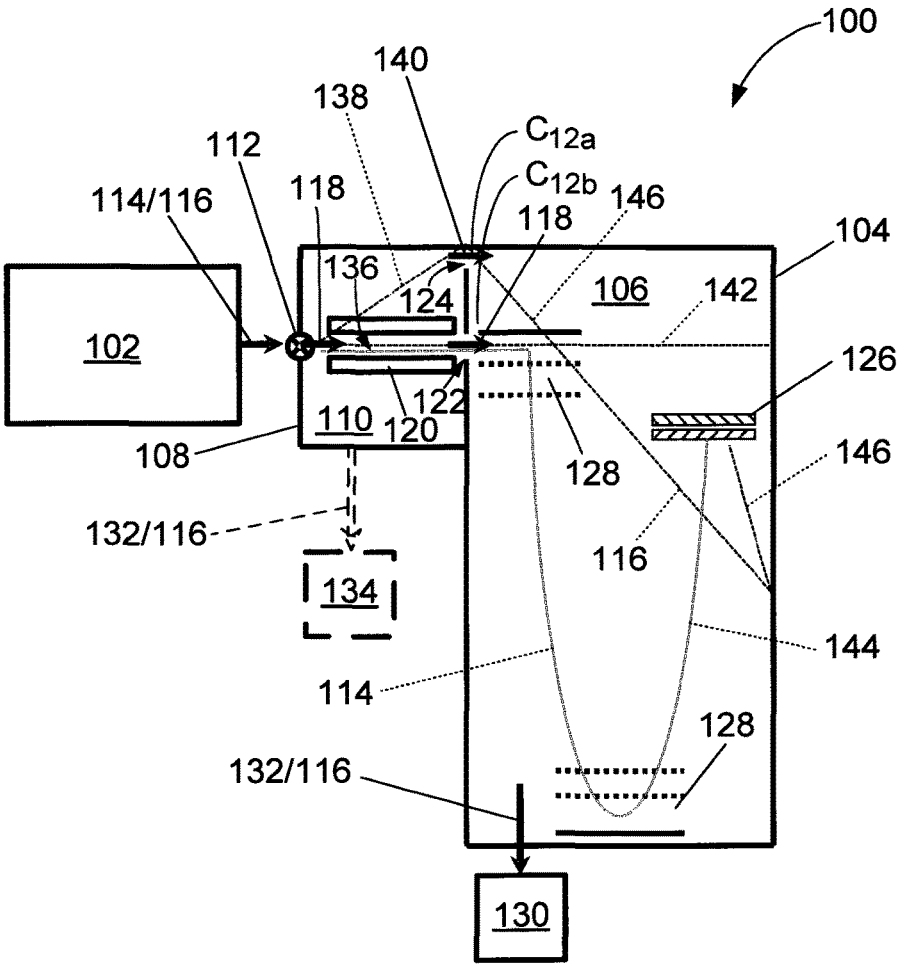

FIG. 1 is a schematic view of an exemplary time-of-flight mass spectrometry (TOFMS) system 100. TOFMS system 100 includes an ion source 102. In the exemplary embodiment, ion source 102 is an atmospheric pressure ionization (API) system. Alternatively, any ion source that enables operation of TOFMS system 100 as described herein is used. TOFMS system 100 also includes a first enclosure 104 that defines a first chamber 106. TOFMS system 100 further includes a second enclosure 108 that defines a second chamber 110. TOFMS system 100 also includes a valve 112 coupling ion source 102 with second chamber 110. Valve 112 is configured to inject ionized molecules 114 and neutral molecules 116 into second chamber 110 as a plurality of pulses 118. Valve 112 is pulsed through a control system (not shown). TOFMS system 100 further includes an ion guide 120 positioned within second chamber 110 and aligned with valve 112. Ion guide 120 is substantially cylindrical. First enclosure 104 and second enclosure 108 define an ion inlet aperture 122 and a neutral inlet aperture 124 that couple first chamber 106 and second chamber 110 in fluid communication with each other. Ion inlet aperture 122 is aligned with ion guide 120. Neutral inlet aperture 124 is positioned a sufficient distance away from ion inlet aperture 122 for reasons described further below. TOFMS system 100 also includes a detector 126 positioned in first chamber 106, where detector 126 is a time-of-flight mass analyzer. TOFMS system 100 further includes a plurality of ion transmission devices, i.e., in the exemplary embodiment, multi-element ion optics 128.

Also, in the exemplary embodiment, first chamber 106 is typically maintained under vacuum through a first vacuum pump 130 coupled in flow communication with first chamber 106. First vacuum pump 130 is configured to pull materials, such as, and without limitation, air (or carrier gas) 132 and neutral molecules 116 from first chamber 106 to maintain a predetermined vacuum therein. In some embodiments, a plurality of first vacuum pumps 130 are coupled to first chamber 106. Similarly, in some embodiments, second chamber 110 is maintained under vacuum through a second vacuum pump 134 (shown in phantom) coupled in flow communication with second chamber 110. Second vacuum pump 134 is configured to pull materials, such as, and without limitation, air (or, carrier gas) 132 and neutral molecules 116 from second chamber 110 to maintain a predetermined vacuum therein, thereby facilitating removal of neutral inlet aperture 124. As such, using neutral inlet aperture 124 rather than second vacuum pump 134 facilitates reducing a size and weight of TOFMS system 100. In some embodiments, a plurality of second vacuum pumps 134 are coupled to second chamber 110. Therefore, in all embodiments, first chamber 106 is a vacuum chamber and in some embodiments second chamber 110 is a vacuum chamber. Regardless, in all embodiments, the pressure in second chamber 110 is greater than the pressure in first chamber 106.

Further, in the exemplary embodiment, valve 112, ion guide 120, and ion inlet aperture 122 define an ion/neutral transmission path 136 through which pulse 118 including both ions 114 and neutrals 116 are transmitted. Also, a portion 138 of pulse 118 that includes mostly neutral molecules 116 are not affected by ion guide 120 and fan out upon entry into second chamber 110 such that a plurality of neutrals 116 define a neutral stream 140 that enters first chamber 106 as a function of the momentum of neutrals 116 and the differential pressure between second chamber 110 and first chamber 106. Those neutrals 116 channeled into first chamber 106 through ion inlet aperture 122 define a neutral stream 142 that transits first chamber 106 such that it does not interact with detector 126, since detector 126 is positioned a predetermined distance from neutral stream 142. Many of those neutrals 116 migrating within first chamber 106 are removed through vacuum pump 130.

Moreover, in the exemplary embodiment, multi-element ion optics 128, detector 126, and ion inlet aperture 122 are positioned and aligned to define a first, i.e., ion transmission path 144. Two ion optics 128 are shown, however, any number of ion optics 128 that enable operation of system 100 as described herein are used. Ion optics 128 channel and accelerate ionized molecules 114 through first transmission path 144 by inducing electric fields substantially orthogonal to ions 114. As such, multi-element ion optics 128 are configured to alter the direction of transmission of ionized molecules 114 between ion inlet aperture 122 and detector 126. Neutral molecules 116 in pulse 118 are not affected by ion optics 128 and continue to travel in a substantially unaltered course as neutral stream 142. Ion transmission path 144 is shown as a line, however, this is for illustrative purposes since the stream of ions 114, even though channeled by ion optics 128, will tend to expand somewhat in volume and path 144 as shown is representative.

In addition, in the exemplary embodiment, those neutral molecules 116 in pulse portion 138 that transit through neutral inlet aperture 124 are directed towards the inner walls of first enclosure 104 such that a second, i.e., neutral transmission path 146 is defined within first chamber 106. Neutral transmission path 146 is one of a large number of potential paths for neutrals 116 because neutrals 116 tend to spread out when not physically constrained. In some embodiments of system 100, first enclosure 106 includes a plurality of baffles or walls therein such that routes for neutral 116 are more circuitous. Therefore, neutral transmission path 146 is representative of one path of many for neutrals 116 to travel to detector 126. Also, many neutrals 116 will scatter within first chamber 106 as they collide with enclosure 104 such that they do not approach detector 126. As the scattering neutrals 116 are removed through vacuum pump 130, the pressure wave induced by neutrals 116 is diminished and decays at a predetermined rate. As such, the number of neutrals 116 from pulse 118 that actually intersect detector 126 is significantly reduced. As a result of extending, i.e., elongating neutral transmission path 146 and accelerating ions 114 through ion transmission path 144, ions 114 intersect detector 126 prior to arrival of the pressure wave induced by neutrals 116. Therefore, the time elapsed since the generation of pulse 118, the arrival of the first wave of ions 114, the subsequent arrival of the pressure wave with neutrals 116, and the sufficient decrease in pressure in first chamber 106 is predetermined and a second pulse 118 may be introduced without significant interference from the remains of the first pulse 118. For those embodiments with vacuum pump 134 and no neutral inlet aperture 124, those neutrals 116 not channeled to first chamber 106 are removed through vacuum pump 134.

In operation of TOFMS system 100, a portion of a sample, i.e., pulse 118 is pulsed into second chamber 110 from ion source 102, e.g., an API device. Pulse 118 includes a plurality of ionized molecules 114 and a plurality of neutral molecules 116. Pulse 118 is directed towards ion guide 120. At least a portion of neutral molecules 138, i.e., neutral stream 140 is channeled into first enclosure 104 through neutral inlet aperture 124. Once neutral stream 140 is in first enclosure 104, at least a portion of neutral stream 140 is directed towards detector 126 through neutral transmission path 146. At least a portion of neutral stream 140 channeled into first enclosure 104 from second enclosure 108 induces a pressure therein that decays at a predetermined rate. Moreover, at least a portion of the plurality of ionized molecules 114 in pulse 118 are channeled into first enclosure 104 through ion inlet aperture 122. Neutral molecules 116 in pulse 118 are not affected by ion optics 128 and continue to travel in a substantially unaltered course as neutral stream 142. Therefore, ionized molecules 114 and neutral molecules 116 in neutral stream 142 are separated by space.

Also, in operation, at least a portion of ionized molecules 114 are accelerated and channeled through first enclosure 104 to detector 126 through ion transmission path 144. A plurality of multi-element ion optics 128 at least partially define first transmission path 144 through altering the direction of at least a portion of ionized molecules 114. Multi-element ion optics 128 subject ionized molecules 114 to electric fields (not shown) configured to accelerate ionized molecules 114 in ion transmission path 144 away from neutral molecules 116 in neutral transmission path 146. As such, ionized molecules 114 and neutral molecules 116 are channeled in first enclosure 104 such that ionized molecules 114 arrive at detector 126 prior to arrival of neutral molecules 116. Accordingly, the high voltage typically used for detector 126 may be turned on upon pulsing of valve 112 to facilitate analyzing ions 114 and then turned off prior to arrival of the neutral molecule pressure wave, thereby extending the service life of detector 126. As such, ionized molecules 114 in first transmission path 144 and neutral molecules 116 in second transmission path 146 separated by space and time.

Further, in operation, prior to injection of a second pulse 118 into second enclosure 108, the pressure in first enclosure 104 is decreased through vacuum pump 130. Also, in some embodiments, vacuum pump 134 decreases the pressure in second enclosure 108 such that the pressure in second enclosure 108 is greater than the pressure in first enclosure 104.

Figure 2:
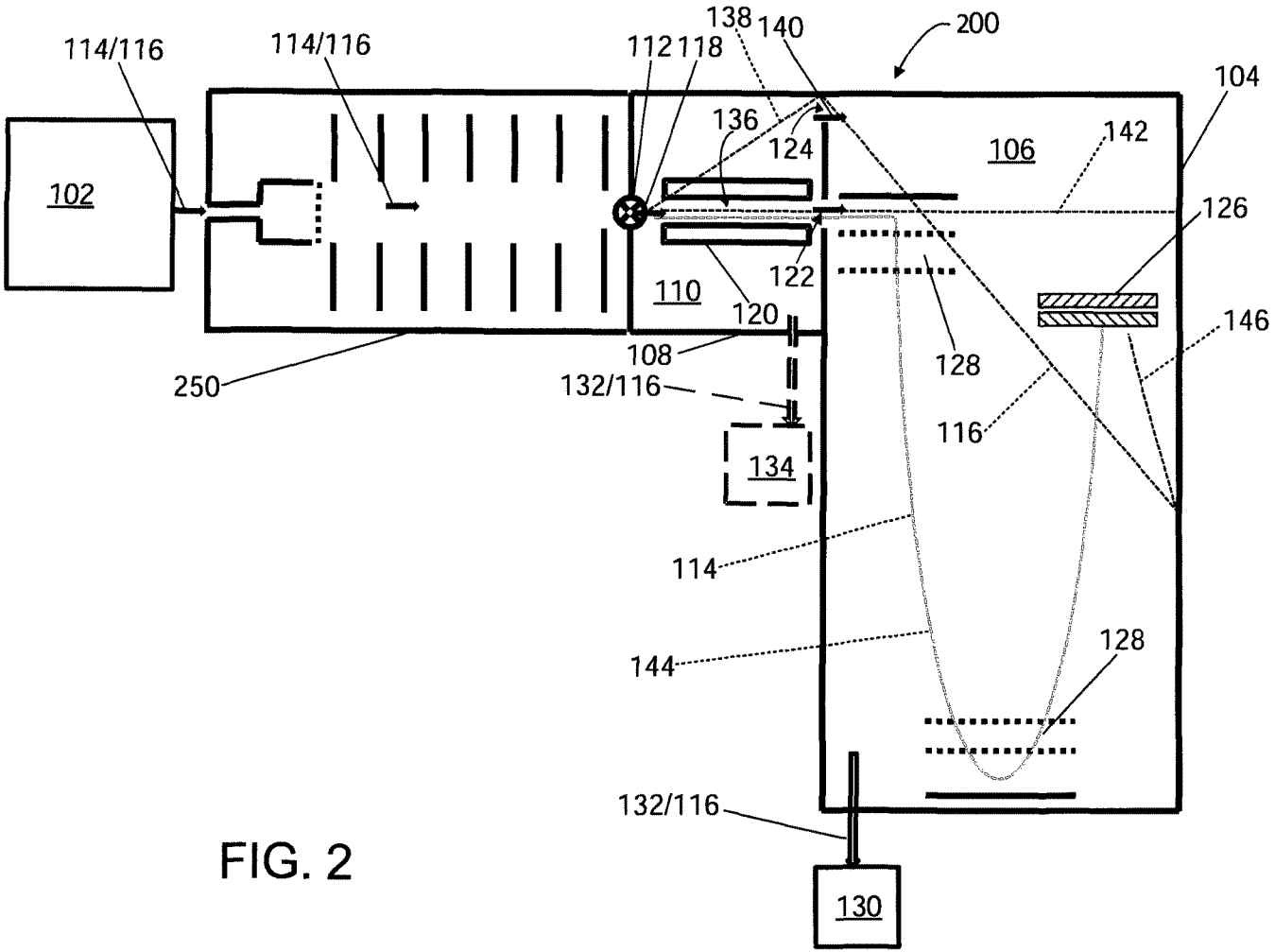

FIG. 2 is a schematic view of an alternative time-of-flight mass spectrometry (TOFMS) system 200 with an ion mobility spectrometry (IMS) device 250. System 200 is substantially similar to system 100 (shown in FIG. 1) with the exception that system 200 includes IMS device 250 coupled to second enclosure 108 with valve 112 positioned therebetween. IMS device 250 is coupled in flow communication with ion source 102 such that IMS device 250 receives ions 114 and neutrals 116 from ion source 102. IMS device 250 transmits ions 114 and neutrals 116 to valve 112. Operation of system 200 is substantially similar to that of system 100 with the exception that IMS device 250 is operated to separate ions 114 according to their respective mobilities at characteristic speeds that are related to the size and shape of ion molecules 114. Neutrals 116 are not affected by the applied electrostatic field.

Figure 3:
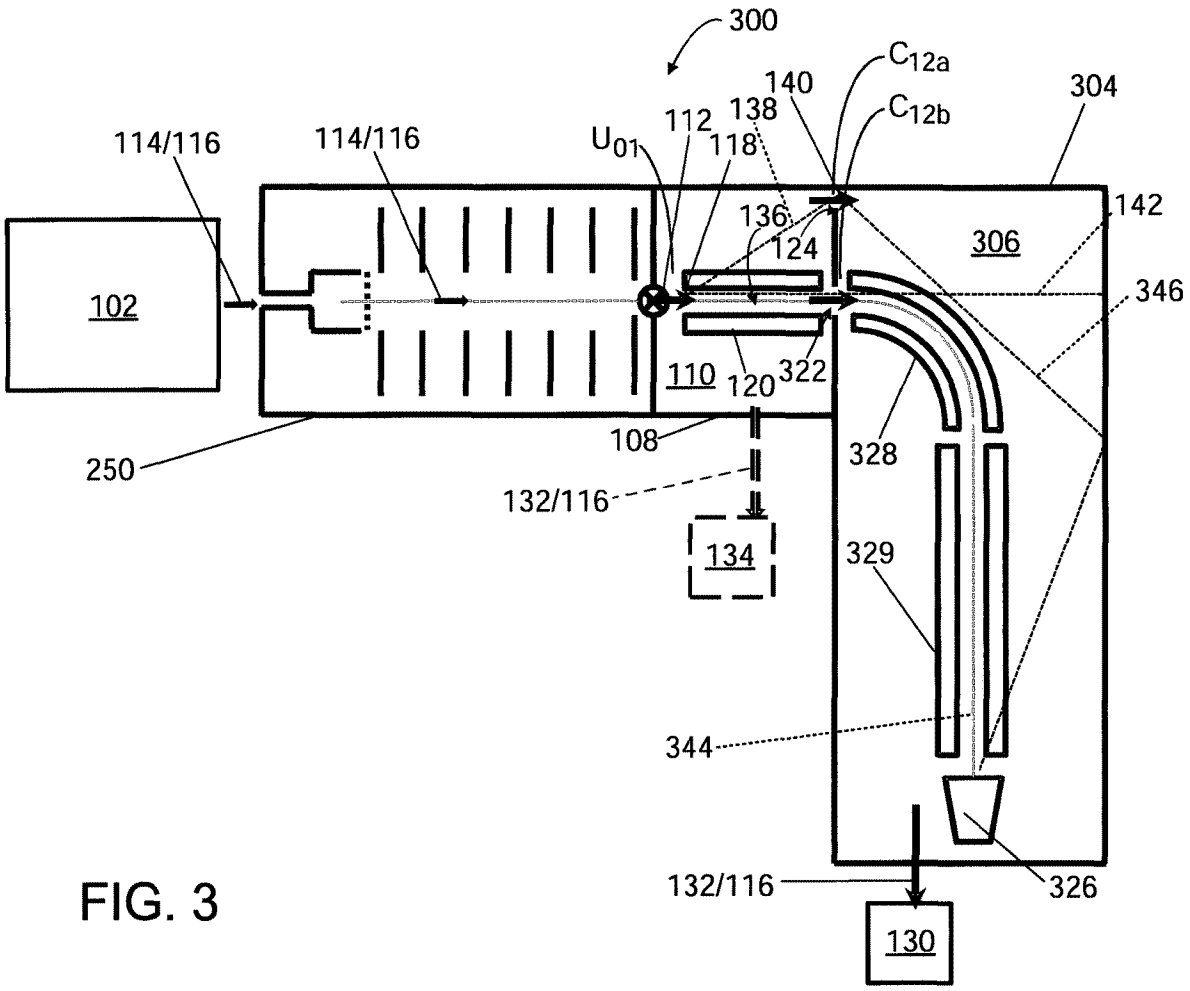

FIG. 3 is a schematic view of an exemplary quadrupole mass spectrometry (QMS) system 300 with IMS device 250. System 300 is similar to system 200 (shown in FIG. 2) with the differences set forth below. Rather than multi-element ion optics 128 (shown in FIG. 2) operating as ion transmission guides, system 300 includes an ion guide 328. In the exemplary embodiment, ion guide 328 is substantially tubular and curved approximately 90 degrees. Ion guide 328 is aligned with an ion inlet aperture 322 that is similar to ion inlet aperture 122 (shown in FIG. 2). A quadrupole mass analyzer 329 is substantially cylindrical and is aligned with ion guide 328. The alignment of ion inlet aperture 322, ion guide 328, and quadrupole mass analyzer 329 defines a first transmission path, i.e., an ion transmission path 344. Also, rather than detector 126 (a time-of-flight mass analyzer) (shown in FIG. 2), system 300 includes a detector 326 that detects ions transmitted through quadrupole mass analyzer 329.

In addition, QMS system 300 includes a first enclosure 304 that defines a first chamber 306 configured to house ion guide 328, quadrupole mass analyzer 329, and detector 326. Furthermore, those neutral molecules 116 in pulse portion 138 that transit through neutral inlet aperture 124 are directed towards the inner walls of first enclosure 304 such that a second, i.e., neutral transmission path 346 is defined within first chamber 306. Neutral transmission path 346 is one of a large number of potential paths for neutrals 116 because neutrals 116 tend to spread out when not physically constrained. Therefore, neutral transmission path 346 is representative of one path of many for neutrals 116 to travel to detector 326. Also, many neutrals 116 will scatter within first chamber 306 as they collide with enclosure 304 such that they do not approach detector 326.

Operation of QMS system 300 is similar to operation of TOFMS system 200 with the following exceptions. In operation, at least a portion of ionized molecules 114 are accelerated and channeled through first enclosure 304 to detector 326 through ion transmission path 344. Ion guide 328 and quadrupole mass analyzer 329 at least partially define first transmission path 344 through altering the direction of at least a portion of ionized molecules 114. Ion guide 328 and quadrupole mass analyzer 329 subject ionized molecules 114 to electric fields (not shown) configured to accelerate ionized molecules 114 in ion transmission path 344 away from neutral molecules 116 in neutral transmission path 346. As such, ionized molecules 114 and neutral molecules 116 are channeled in first enclosure 304 such that ionized molecules 114 arrive at detector 326 prior to arrival of neutral molecules 116. Therefore, in QMS system 300, similar to TOFMS systems 100 and 200 (shown in FIGS. 1 and 2, respectively), ionized molecules 114 and neutral molecules 116 are separated through space and time.

Figure 4:
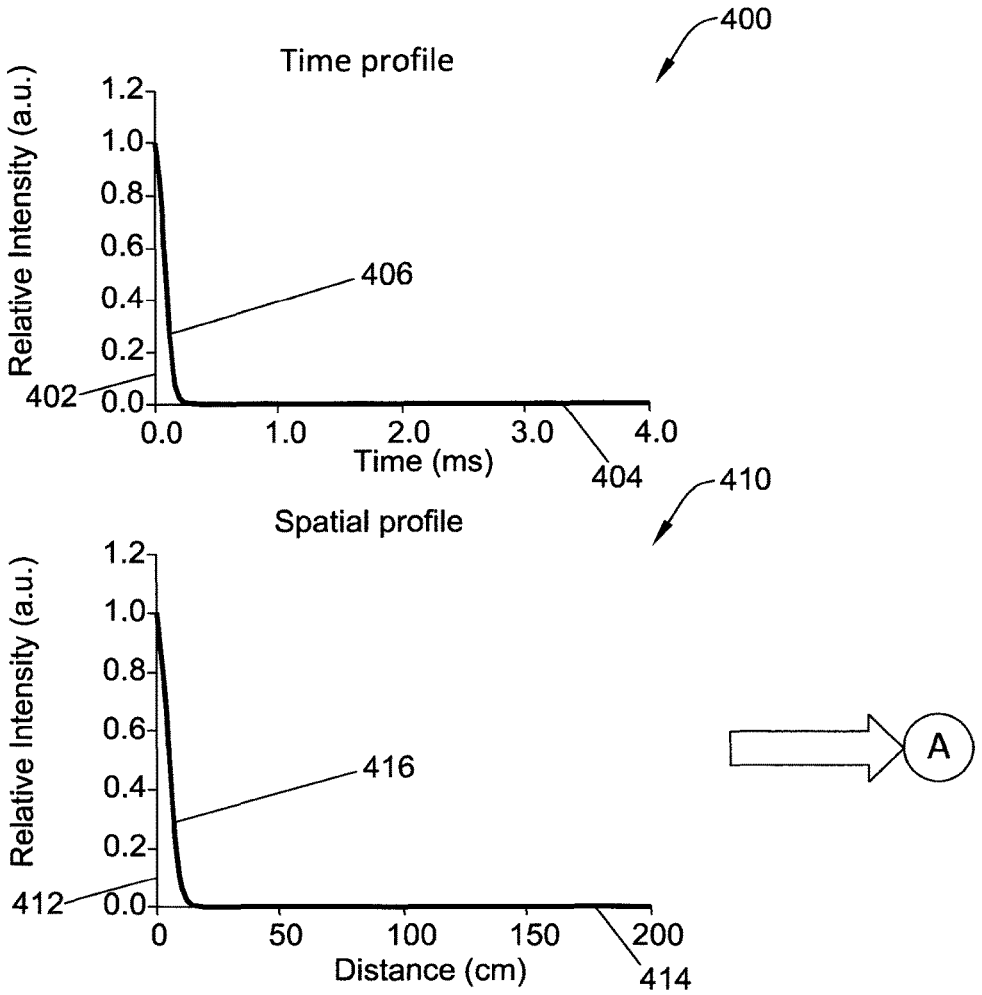

FIG. 4 is a graphical view of a calculated initial distribution in time and space of neutral molecules 116 and ionized molecules 114 (both shown in FIGS. 1, 2, and 3) after they are transmitted substantially simultaneously within TOFMS system 100, TOFMS system 200, and QMS system 300 (shown in FIGS. 1, 2, and 3, respectively). Specifically, FIG. 4 includes a time profile graph 400. Graph 400 includes a y-axis 402 representative of a relative intensity of ions 114 and neutrals 116 in arbitrary units (a.u.) extending from 0.0 to 1.2 in increments of 0.2. Graph 400 also includes an x-axis 404 representative of time in milliseconds (ms) extending from 0.0 to 4.0 in increments of 1.0. Time 0.0 ms represents the point that valve 112 (shown in FIGS. 1, 2, and 3) is approximately half-open such that ionized molecules 114 and neutral molecules 116 are allowed to enter second chamber 110 simultaneously. Temporal curve 406 shows a calculated relative intensity of ions 114 and neutrals 116 as they transit through second chamber 110 and first chamber 106 (shown in FIGS. 1 and 2) and first chamber 306 (shown in FIG. 3) to detector 126 (shown in FIGS. 1 and 2) and detector 326 (shown in FIG. 3). Curve 406 is generated assuming a sample gas pulse with a Gaussian width of 0.2 ms.

Similarly, FIG. 4 includes a spatial profile graph 410. Graph 410 includes a y-axis 412 representative of a relative intensity of ions 114 and neutrals 116 in arbitrary units (a.u.) extending from 0.0 to 1.2 in increments of 0.2. Graph 410 also includes an x-axis 414 representative of distance in centimeters (cm) extending from 0 to 200 in increments of 50. Distance 0 cm represents the position of valve 112. Spatial curve 416 shows a calculated relative intensity of ions 114 and neutrals 116 as they transit through second chamber 110 and first chamber 306 to detector 326. Curve 416 is generated assuming a sample gas pulse with a Gaussian width of 0.2 ms.

In general, the following equations describe the temporal and spatial distribution for a pulsed sample volume containing neutral and ionic molecules. It is assumed that the sample pulse temporal profile is represented by a Gaussian distribution that includes the standard deviation, or sigma ($\sigma$) as a half width (in time).

$$N(t) = e^{-\left(\frac{t-t_0}{\sigma}\right)^2}, \tag{1}$$

where N(t) represents the relative intensity of ions 114 and neutrals 116 as a function of time since pulsing, t represents the time since pulsing, and $t_0$ represents the middle of the opening period of valve 112 (where the relative intensity is approximately at its peak value). Equation (1) is used to generate temporal curve 406 in time profile graph 400.

The spatial profile for ions and neutrals as a function of time after the sample pulse trigger is given by Eq. 2:

$$N_i(d) = e^{-\left[\left(\frac{t-t_d(v_i/v_n)}{\sigma(v_i/v_n)}\right)\right]^2}, \tag{2}$$

where $N_i(d)$ represents the relative intensity as a function of distance traveled by ions 114 and neutrals 116 since pulsing, d is the distance from valve 112, t represents the time since pulsing, $t_d$ represents the time elapsed after the sample pulse, $v_n$ represents the velocities of neutral molecules 116, $v_i$ represents the velocities of ionized molecules 114, and $\sigma$ as a half width of a Gaussian distribution. The neutral velocity $v_i$ is assumed to be that of nitrogen ($N_2$) at 150° C., which is approximately $6.31\times10^4$ cm/s (assuming a heated inlet of 150° C.). Equation (2) is used to generate spatial curve 416 in distance profile graph 410, which is the case for $t_d$=0.

The velocities of ionized molecules 114 ($v_i$) are given by Eq. 3:

$$v_i = \frac{d}{t_d} = \left(\frac{2qE}{m_i}\right)^{1/2} \tag{3}$$

where d is the distance from valve 112, $t_d$ represents the time elapsed after the sample pulse, q represents the charge of ionic molecules 114, E represents the ionic energy imparted by an electric field, and $m_i$ represents the mass of ions 114.

Figure 5:
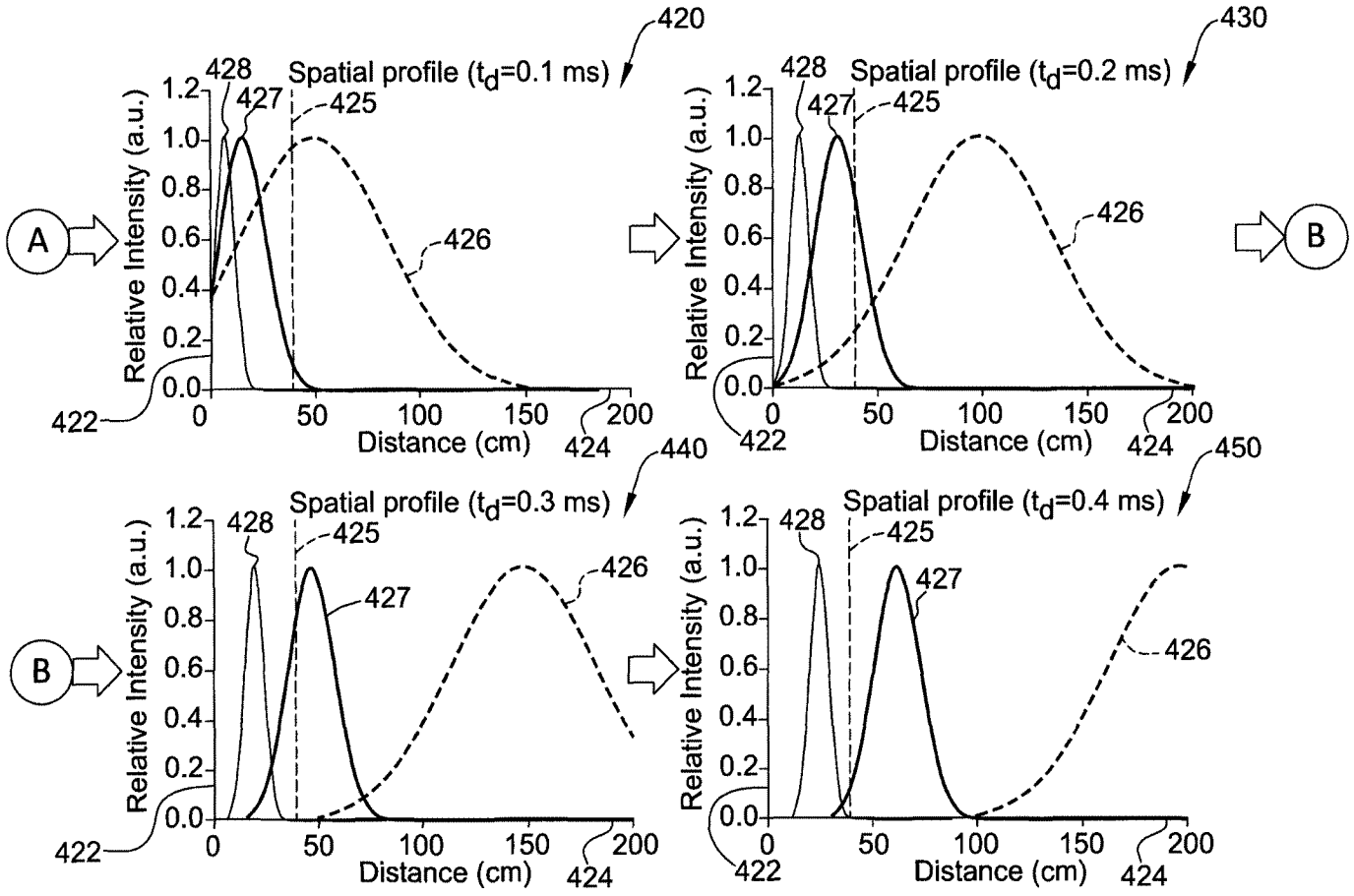

FIG. 5 is a graphical view of typical molecule profiles showing calculated ion and neutral pulse trajectories as a function of time in QMS system 300 (shown in FIG. 3). Specifically, FIG. 5 includes a series of spatial profile graphs 420, 430, 440, and 450 representing the travel of ions 114 and neutrals 116 at time ($t_d$) after valve 112 (shown in FIG. 3) pulses ions 114 and neutrals 116 into second chamber 110 at time $t_0$ for $t_d$=0.1 ms, 0.2 ms, 0.3 ms, and 0.4 ms, respectively, each described below.

Spatial profile graphs 420, 430, 440, and 450 include a y-axis 422 representative of a relative intensity of ions 114 and neutrals 116 in arbitrary units (a.u.) extending from 0.0 to 1.2 in increments of 0.2. Graphs 420, 430, 440, and 450 also include an x-axis 424 representative of distance in centimeters (cm) extending from 0 to 200 in increments of 50. Distance 0 cm represents valve 112 and the position 425 of detector 326 is indicated at approximately 40 cm. A spatial ion curve 426 shows a calculated relative intensity of ions 114 with a mass-to-charge (m/z) ratio of 40 as compared to a spatial ion curve 427 that shows a calculated relative intensity of ions 114 with a m/z of 400 and a spatial neutrals curve 428. As can be seen in graphs 420 through 450, light ions 114 with a m/z of 40 travel faster than heavier ions 114 with a m/z of 400 and faster than those neutrals 116 that have thermal velocities much less than the accelerated velocities of ions 114. Also, as can be seen in graphs 420 through 450, most of ions 114 with an m/z of 40 and 400 have reached detector 326 prior to neutrals 116 in the neutral pressure wave arriving. These characteristics of ionized molecules arriving at a detector prior to neutral pressure waves due to accelerating and channeling the ions and forcing the neutrals to take an elongated route are also seen in TOFMS systems 100 and 200 (shown in FIGS. 1 and 2, respectively).

FIG. 6 is a tabular view of calculated spatial and temporal properties for ionized molecules 114 and neutral molecules 116 for QMS system 300 (all shown in FIG. 3). The travel distance for neutrals 116 is 40 centimeters (cm) as compared to the total travel distance for ions 114 of 26 cm. Neutrals 116 transit at $6.31*10^4$ cm/s, ions 114 with a m/z of 40 transit at $4.91*10^5$ cm/s, i.e., over 7 times faster than neutrals 116, and ions 114 with a m/z of 400 transit at $1.55*10^5$, i.e., over twice as fast as neutrals 116. Therefore, ions 114, with m/z ratios of 400 and 40 have a transit time of 0.168 ms and 0.053 ms, respectively, as compared to a neutral transit time of 0.633 ms.

FIG. 7 is a tabular view of calculated spatial and temporal properties for ionized molecules 114 and neutral molecules 116 for TOFMSA systems 100 and 200 (shown in FIGS. 1 and 2, respectively). The travel distance for neutrals 116 is 35 cm as compared to the total travel distance for ions 114 of 50 cm. Neutrals 116 transit at a steady $6.31*10^4$ cm/s, ions 114 with a m/z of 40 transit within a range between $3.10*10^5$ cm/s and $6.94*10^5$ cm/s, i.e., over 4 and over 100 times faster than neutrals 116, respectively. Also, ions 114 with a m/z of 400 transit between $9.82*10^4$ cm/s and $2.19*10^4$ cm/s, i.e., over 1.5 and over 34 times faster than neutrals 116, respectively. Therefore, ions 114, with m/z ratios of 400 and 40 have a transit time of 0.060 ms and 0.019 ms, respectively, as compared to a neutral transit time of 0.554 ms. Note that ions 114 travel a longer distance than neutrals 116, however, ions 114 travel much faster.

FIG. 8 is a tabular view, i.e., table 500 of assumptions used to determine spatial and temporal properties for ionized molecules 114 and neutral molecules 116 for the MS systems shown in FIGS. 1, 2, and 3 with a two-chamber vacuum system. In general, the previous discussion described the events leading up to when the neutral pressure wave reaches the detector. The following describes the entire sample pulse time period leading up to the pressure rise followed by the pressure drop due to pumping through the associated vacuum pumps.

The operable equations governing the pressures $P_2$ and $P_1$ for the vacuum interface region, i.e., second chamber 110 (shown in FIGS. 1-3) and the MS detector region, i.e., first chamber 106 (shown in FIGS. 1-2) and 306 (shown in FIG. 3), respectively, following a pulsed sample input $U_p$ are given by:

$$P_2(t) = P_0 + \frac{U_p}{V_2} e^{-(C_{12a}+C_{12b})t/V_2} \tag{4}$$

and, $$P_1(t) = P_2(0)[1 - e^{-(C_{12a}+C_{12b})t/V_2}]e^{-S_1 t/V_1}, \tag{5}$$

where $P_2(t)$ represents pressure as a function of time in second chamber 110, $P_1(t)$ represents pressure as a function of time in first chamber 106/306, $P_0$ represents a base pressure (in units of milliTorr (mTorr)) in second chamber 110, $U_p$ (in units of atm-cm$^3$) is given by the product of the continuous gas throughput (atm-cm$^3$/s) for the pulsed valve orifice and the time the valve is open (this represents the instantaneous gas throughput per pulse period), $V_1$ and $V_2$ represent the volumes (in units of cm$^3$) of first chamber 106/306 and second chamber 110, respectively, $P_2(0)$ represents the instantaneous pressure (in units of mTorr) in second chamber 110 due to the gas pulse and is approximately equal to $U_p/V_1$, $C_{12a}$ represents the conductance (in units of liters per second, i.e., L/s) for neutral inlet aperture 124, $C_{12b}$ represents the conductance (in units of L/s) for ion inlet aperture 122, and $S_1$ represents the pumping speed (in units of L/s) from first chamber 106/306. In the exemplary embodiment, it is assumed that only first chamber 106/306 is pumped through vacuum pump 130 such that systems 100, 200, and 300 are facilitated to be compact systems. However, in alternative embodiment, pumping of multiple chambers of the vacuum system is performed.

Using an instantaneous pressure $P_2(0)$ is necessary to make equations (4) and (5) analytically solvable, however, this is an acceptable approximation because the pressure wave enters into second chamber 110, but undergoes a time lag due to the neutral molecular velocities on entering into first chamber 106/306 and this time lag is much greater than the width of the pulsed valve introduction of the sample, thus this can be treated as instantaneous. In addition, the repetition rate for executing an entire cycle is 20 cycles per second, i.e., 20 Hz. The assumptions given in FIG. 8 apply to any form of MS, e.g., TOFMS systems 100 and 200 (shown in FIGS. 1 and 2, respectively) and QMS system 300 (shown in FIG. 3).

Figure 9:
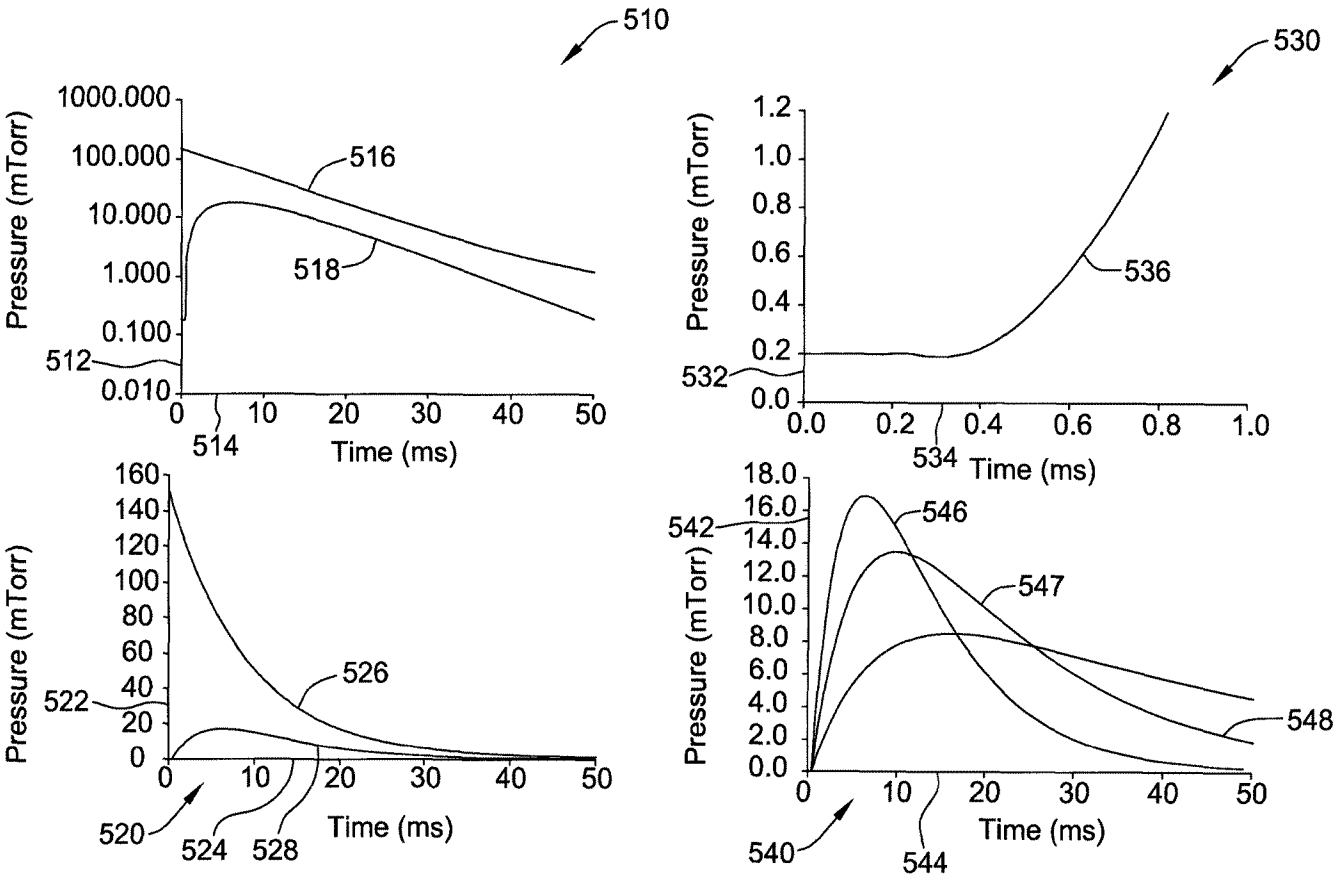

FIG. 9 is a graphical view of pressure transients in a plurality of different vacuum chambers of the MS systems 100, 200, and 300 (shown in FIGS. 1, 2, and 3, respectively) with a two-chamber vacuum system and using the assumptions from table 500 (shown in FIG. 8). Specifically, FIG. 9 includes a series of pressure profile graphs 510, 520, 530, and 540 representing the pressures in MS systems 100, 200, and 300 at time (t) after valve 112 (shown in FIGS. 1-3) pulses ions 114 and neutrals 116 into second chamber 110, each temporal profile graph described below.

As described above, the two paths for neutrals 116 to enter into first chamber 106/306 from second chamber 110 are through neutral inlet aperture 124 with conductance $C_{12a}$ and ion inlet aperture 122/322 for ions 114 and neutrals 116 with conductance $C_{12b}$. Such apertures 124 and 122/322 facilitate pressure in second chamber 110 to pump into first chamber 106/306 faster in this particular case where no direct pumping of second chamber 110 is assumed.

Pressure profile graph 510 includes a y-axis 512 representative of pressure in milliTorr (mTorr) extending from 0.010 to 1000.000 in logarithmic increments of $10^x$. Graph 510 also includes an x-axis 514 representative of time in (ms) extending from 0 to 50 in increments of 10. Time=0 ms represents valve 112 open. A temporal curve 516 represents the calculated pressure transient in second chamber 110. A temporal curve 518 represents the calculated pressure transient in first chamber 106/306.

Pressure profile graph 520 includes a y-axis 522 representative of pressure in mTorr extending from 0 to 160 in linear increments of 20. Graph 520 is a linear version of graph 510. Graph 520 also includes an x-axis 524 representative of time in (ms) extending from 0 to 50 in increments of 10. Time=0 ms represents valve 112 open. A temporal curve 526 represents the calculated pressure transient in second chamber 110. A temporal curve 528 represents the calculated pressure transient in first chamber 106/306.

As shown in graphs 510 and 520, the pressure in first chamber 106/306 drops to 0.1 mtorr after 50 milliseconds, which is typically a sufficiently low pressure to allow the next sampling pulse to start and to perform a mass analysis on ions 114.

Pressure profile graph 530 includes a y-axis 532 representative of pressure in mTorr extending from 0.0 to 1.2 in linear increments of 0.2. Graph 530 also includes an x-axis 534 representative of time in (ms) extending from 0 to 1.0 in increments of 0.2. Time=0 ms represents valve 112 open. A temporal curve 536 represents the calculated pressure transient in first chamber 106/306. Graph 530 shows the time lag for the pressure rise due to the transit time of the neutral molecules.

Pressure profile graph 540 includes a y-axis 542 representative of pressure in mTorr extending from 0.0 to 18.0 in linear increments of 2. Graph 540 also includes an x-axis 544 representative of time in (ms) extending from 0 to 50 in increments of 10. Time=0 ms represents valve 112 open. Graph 540 shows the pressure rise and fall in first chamber 106/306 for different volumes of first chamber 106/306. A temporal curve 546 represents the calculated pressure transient in first chamber 106/306 when the volume is 100 $cm^3$. A temporal curve 547 represents the calculated pressure transient in first chamber 106/306 when the volume is 200 $cm^3$. A temporal curve 548 represents the calculated pressure transient in first chamber 106/306 when the volume is 500 $cm^3$. Graph 540 shows that smaller volumes enable faster pump down times although the peak pressure will be higher.

Figure 10:
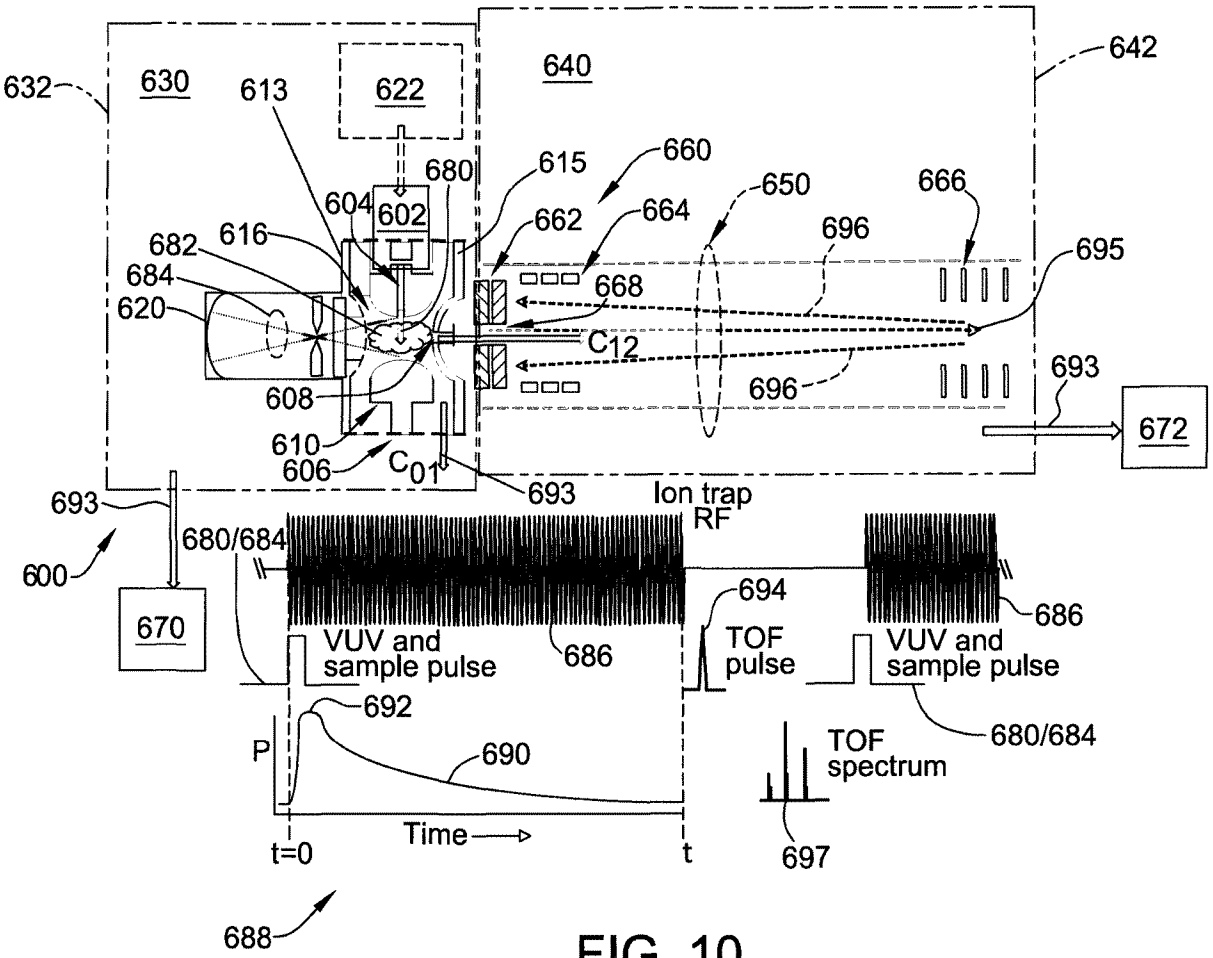

FIG. 10 is a schematic view of an exemplary quadrupole ion trap, time-of-flight (QIT-TOF) MS system 600. System 600 includes a sample injection device 602 defining a sample injection aperture 604. In the exemplary embodiment, sample injection device 602 is a pulsed valve similar to valve 112 (shown in FIGS. 1, 2, and 3). Sample injection device 602 is configured to pulse neutral molecules through a control system (not shown). System 600 also includes an ion trap 606 defining an ion outlet aperture 608. Ion trap 606 is coupled to sample injection device 602. Ion trap 606 includes a middle toroidal ring electrode device 610 that at least partially defines an ion trap cavity 616. Ion trap cavity 616 is also partially defined by a first end cap 613 and a second end cap 615 (that defines outlet aperture 608). Ion trap 606 generates an electric field in the radio frequency (RF) spectrum with a field strength sufficient to contain ions.

QIT-TOF MS system 600 further includes a pulsed vacuum ultraviolet (VUV) ion source 620 coupled to ion trap 606. Alternatively, an API system 622 (shown in phantom) is coupled to sample injection device 602. VUV ion source 620 includes end cap 613. VUV ion source 620 ionizes a sample of neutral molecules injected into ion trap 606, thereby generating a plurality of ionized molecules within ion trap 606. Ion trap 606 uses an RF field to maintain the ionized molecules therein while neutral molecules migrate out of ion trap 606 until a predetermined pressure is attained in ion trap 606. Sample injection device 602, ion trap 606, and VUV ion source 620 are positioned within a first chamber 630 defined by a first enclosure 632 of system 600.

QIT-TOF MS system 600 also includes a second chamber 640 defined by a second enclosure 642. A drift tube 650 is positioned within second chamber 640. System 600 includes a TOFMS detection system 660 in second chamber 642 aligned with ion outlet aperture 608. TOFMS detection system 660 includes a detector 662, a plurality of ions optics 664, and a reflectron 666. Alternatively, system 600 includes any ion detection system that enables operation of system 600 as described herein, including, and without limitation, an ion trap mass spectrometer with an ion scan out mode, where ion trap 606 itself can be the mass spectrometer by scanning the ions out in some predetermined sequence of priority as a function of mass in a conventional method. Also, alternatively, rather than a coaxially aligned configuration such as system 600, where ion outlet aperture and a center opening 668 of detector 662 are coaxially aligned, an off-axis configuration similar to system 100 (shown in FIG. 1) is used.

In the exemplary embodiment, system 600 includes a plurality of vacuum pumps, i.e., a first vacuum pump 670 coupled in flow communication with first chamber 630 and ion trap cavity 616 and a second vacuum pump 672 coupled in flow communication with second chamber 640. First vacuum pump 670 is configured to facilitate decay of the population of neutral molecules within ion trap cavity 616 and first enclosure 630. An induced pressure in ion trap cavity 616 is greater than a pressure induced in second chamber 640.

In operation, a neutral molecule pulse 680 is injected, i.e., pulsed into ion trap cavity 616 from sample injection device 602 through sample injection aperture 604. Substantially simultaneously, VUV ion source 620 is pulsed on to generate ionized molecules 682 through ionizing a portion of the neutral molecules in pulse 680 through illumination with a VUV pulse 684.

Also, in operation, substantially simultaneously with generation of pulses 680 and 684, ion trap 606 is energized. Ion trap 606 operates within a predetermined portion of the radiofrequency (RF) spectrum to generate a containment field through a voltage applied to middle ring electrode device 610. Specifically, an ion trap waveform 686 is generated with a predetermined frequency and voltage amplitude to generate the ion containment field for a predetermined temporal period. As such, a controller (not shown) and associated circuitry (not shown) are configured to facilitate rapid sample pulsing, ionization pulsing, and RF "on/off" features used in the ionization step. Therefore, generating the RF field just after VUV ion source 620 is energized forms ions 682 directly in ion trap cavity 616 and they are immediately contained within the RF field, thereby significantly decreasing a potential for ion transfer losses. In addition, the use of VUV pulses 684 hitting metal portions of ion trap 606 facilitates photoemission of electrons through inducing ejection of low energy electrons from the metal. If the RF field is not energized, then these low energy electrons may be a source of ionization, i.e., photoionization, most particularly in the formation of negative ions by electron attachment and other known negative ionization mechanisms, thereby facilitating formation of negative ions. Since VUV ion source 620 is pulsed, ions 682 are formed and not drift far while the RF field is off and then after ionization is complete, the RF field is turned on to trap the newly formed ions. If the RF field is on during ionization, these electrons can be accelerated to high energy and cause positive ionization of neutral molecules in a manner similar to electron ionization. Therefore, the application of pulsed sample introduction into the ion trap, pulsed ionization inside the ion trap, and the use of a rapid on/off RF field facilitates high instantaneous sample density, high instantaneous ionizing radiation, and very high trapping efficiency, and facilitates very high sensitivity for compact MS systems with reduced vacuum pumping (described further below).

Further, in operation, a pressure versus time profile 688 for ion trap cavity 616 shows a pressure transient curve 690 with a peak 692 generated through injection of neutral molecule pulse 680 into ion trap cavity 616. After a predetermined time (t), the pressure in cavity 616 decreases at a predetermined rate through migration of neutrals 693 from cavity 616 to first enclosure 632 as a function of conductance $C_{01}$ and by pumping neutrals 693 out of enclosure 632 through first vacuum pump 670 while ions 682 remain in ion trap cavity 616.

Based on equations (6) and (7) below, pressure transients in ion trap cavity 616, and second chamber 640 for the vacuum conditions generated therein. In the exemplary embodiment, vacuum pumping for both chambers 630 and 640 is used. However, in some alternative embodiments, only vacuum pump 672 in chamber 640 is used to pump neutrals 693 from chamber 640, vacuum maintenance within chamber 630 is facilitated through conductance $C_{12}$ from ion trap cavity 616 to chamber 640.

The operable equations governing the pressures $P_1$ and $P_2$ for ion trap cavity 616 and the MS detector region, i.e., second chamber 640, respectively, following a pulsed sample input $U_p$ are given by:

$$P_1(t) = P_0 + \frac{U_p}{V_1} e^{-(C_{01}+C_{12})t/V_1} \tag{6}$$

and, $$P_2(t) = P_1(0)[C_{12}/(C_{01}+C_{12})][1 - e^{-(C_{01}+C_{12})t/V_1}]e^{-S_2 t/V_2}, \tag{7}$$

where $P_1(t)$ represents pressure as a function of time in ion trap cavity 616, $P_2(t)$ represents pressure as a function of time in second chamber 640, $P_0$ represents a base pressure (in units of mTorr) in first chamber 630, $U_p$ (in units of atm-cm$^3$) is given by the product of the continuous gas throughput (atm-cm$^3$/s) for e sample injection aperture 604 and the time valve 602 is open (this represents the instantaneous gas throughput per pulse period), $V_1$ and $V_2$ represent the volumes (in units of cm$^3$) of ion trap cavity 616 and second chamber 640, respectively, $P_1(O)$ represents the instantaneous pressure (in units of mTorr) in ion trap cavity 616 due to the gas pulse and is approximately equal to $U_p/V_1$, $C_{01}$ represents the conductance (in units of L/s) for neutral transmission into chamber 630 from ion trap cavity 616, $C_{12}$ represents the conductance (in units of L/s) for ion outlet aperture 608, $S_0$ represents the pumping speed (in units of L/s) from chamber 630, and $S_2$ represents the pumping speed (in units of L/s) from second chamber 640.

Moreover, in operation, a time-of-flight (TOF) pulse 694 is generated upon relaxation of, i.e., de-energizing the RF field within ion trap cavity 616. As such, ions 695 are pulsed into drift tube 650 through ion outlet aperture 608. Ions 682 are analyzed by detector 662 of TOFMS detection system 660. At least a portion of those ions 695 are reflected back as ions 696 by reflectron 666. Detection system 660 generates a TOF spectrum 697. Therefore, QIT-TOF MS system 600 ionized molecules 682 and neutral molecules 693 are separated through space and time.

Further, in operation, prior to injection of second pulses 680 and 684 into ion trap cavity 616, the pressure in second enclosure 642 is decreased through vacuum pump 672. Also, in some embodiments, vacuum pump 670 decreases the pressure in first enclosure 632 and ion trap cavity 616 such that the pressure in ion trap cavity 616 is greater than the pressure in second enclosure 642.

FIG. 11 is a tabular view, i.e., a table 720 of assumptions used to determine spatial and temporal properties for ionized molecules and neutral molecules for the QIT-TOF MS system 600 (shown in FIG. 10) with a two-chamber vacuum system including ion trap cavity 616 and MS detector region 640. Notably, the repetition rate is 60 cycles per second, i.e., 60 Hz.

Figure 12:
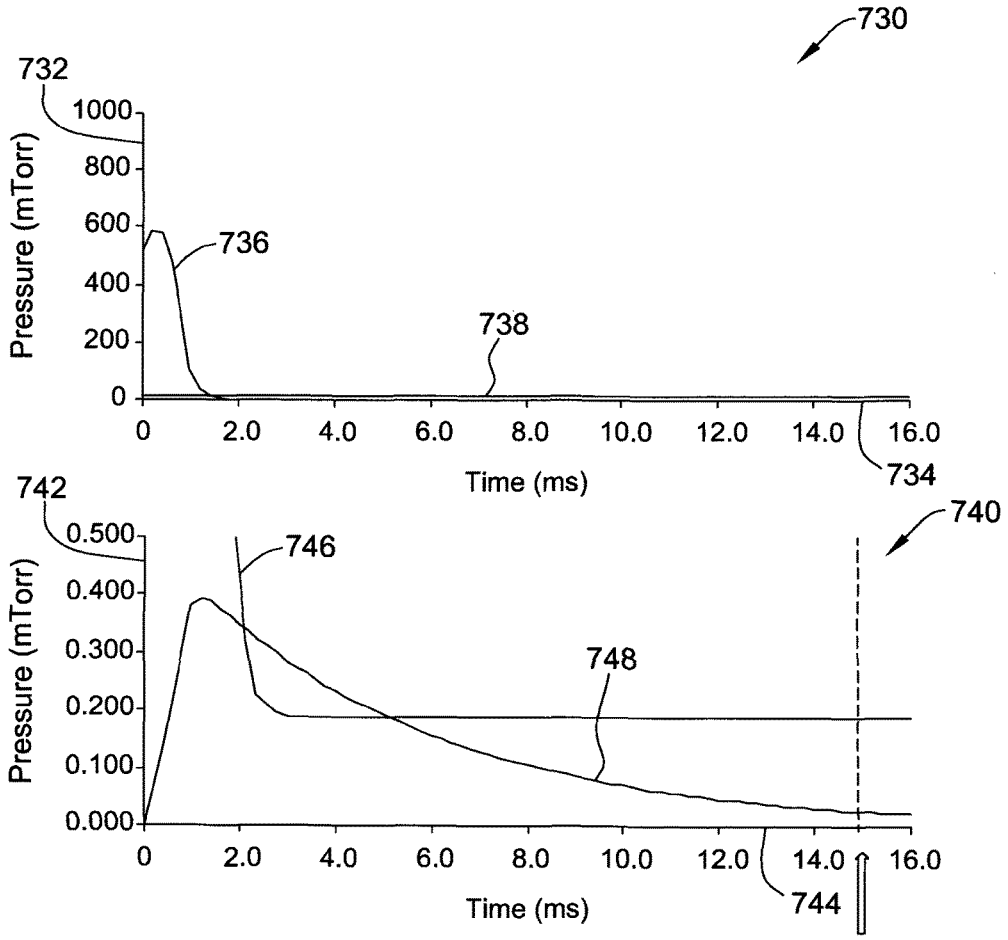

FIG. 12 is a graphical view of pressure transients in a plurality of different vacuum chambers of QIT-TOF MS system 600 (shown in FIG. 10) with a two-chamber vacuum system and using the assumptions from Table 720 (shown in FIG. 11). Specifically, FIG. 12 includes two pressure profile graphs 730 and 740 representing the pressures in MS system 600 at time (t) after pulses 680 and 684 (both shown in FIG. 10) are initiated. Each temporal profile graph is described below.

As described above, the path for neutrals 693 to enter into chamber 630 from ion trap cavity 616 is through the bottom of ion trap 606 through a neutral outlet aperture (not shown) with conductance $C_{01}$. Such neutrals 693 are subsequently removed from first chamber 630 through vacuum pump 670. Similarly, neutrals 693 are channeled from ion trap cavity 616 to second chamber 640 through ion outlet aperture 608 with conductance $C_{12}$ prior to their removal from chamber 640 through vacuum pump 672.

Pressure profile graph 730 includes a y-axis 732 representative of pressure (in units of mTorr) extending from 0 to 1000 in increments of 200. Graph 730 also includes an x-axis 734 representative of time (in units of ms) extending from 0 to 16.0 in increments of 2. Time=0 ms represents pulses 680 and 684 initiating. A temporal curve 736 represents the calculated pressure transient in ion trap cavity 616. A temporal curve 738 represents the calculated pressure transient in second chamber 640.

Pressure profile graph 740 includes a y-axis 742 representative of pressure in mTorr extending from 0.000 to 0.500 in increments of 0.100, i.e., expanded by a factor of 2000 as compared to graph 730. Graph 740 also includes an x-axis 744 representative of time (in units of ms) extending from 0 to 16.0 in increments of 2. Time=0 ms represents pulses 680 and 684 initiating. A temporal curve 746 represents the calculated pressure transient in ion trap cavity 616. A temporal curve 748 represents the calculated pressure transient in second chamber 640. Profile graph 740 is similar to profile graph 730 with the exception of scaling on y-axis 732 and 742 such that in graph 740 the transient in second chamber 640 as represented by curve 748 is visible as compared to curve 738.

As shown in graphs 730 and 740, the pressure in ion trap cavity 616 initial increase to approximately 590 mTorr and drops to approximately 0.18 mTorr after approximately 3 ms. Similarly, second chamber 640 experiences an upward pressure surge from 0 mTorr to approximately 0.390 mTorr in approximately 1.5 milliseconds. From 0.390 mTorr, second chamber 640 steadily decreases to less than 0.05 mTorr at approximately 12 ms. Both pressure decreases are due to pumping through vacuum pumps 670 and 672, respectively. For those embodiments with only pump 672, the decay of the pressure in the ion trap cavity 616 and MS detector region 640 will take longer. This is a reasonable compromise for making MS systems that are compact and low cost. Equation (6) above demonstrates that there is a base or lowest pressure that a pump can achieve for ion trap cavity 616. For ion trap cavity, $P_0$ is 0.18 mtorr and time to reach this base pressure for the assumed conditions is about 3 ms after which it is now possible to perform standard ion trap functions such as the playing of waveforms to isolate and then collisionally dissociate selected ion masses. At approximately 15 ms, the pressure in second chamber 640 is sufficiently low enough for release of ions 682 (shown in FIG. 10) into second chamber 640 for TOF analysis. Therefore, trapping ions in ion tap cavity 616 until the neutral pressure wave in second chamber 640 is sufficiently low facilitates enhanced analysis of ions 682.

Figure 13:
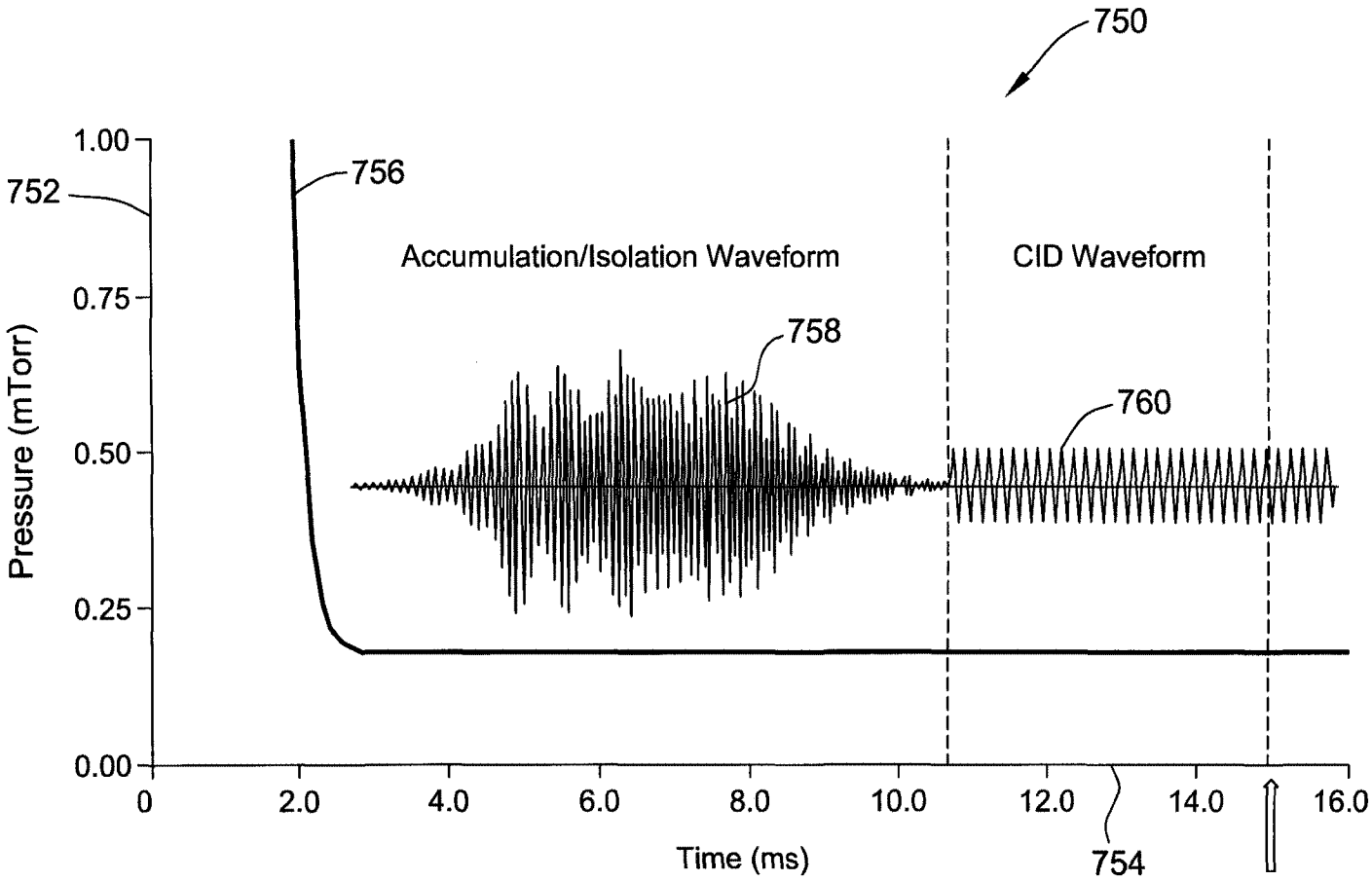

FIG. 13 is a graphical view, i.e., a pressure profile graph 750 of a pressure transient in an ion trap cavity 616 of QIT-TOF MS system 600 (both shown in FIG. 10) and the associated waveforms generated. Pressure profile graph 750 includes a y-axis 752 representative of pressure in mTorr extending from 0.00 to 1.00 in increments of 0.25. Graph 750 also includes an x-axis 754 representative of time (in units of ms) extending from 0 to 16.0 in increments of 2. Time=0 ms represents pulses 680 and 684 (both shown in FIG. 10) initiating. A temporal curve 756 represents the calculated pressure transient in ion trap cavity 616. Curve 756 is substantially similar to curve 746 (shown in FIG. 13).

Graph 750 also includes an accumulation/isolation waveform 758 and a collision induced dissociation (CID) waveform 760 that may be applied at different times to end caps 613 and 615 (both shown in FIG. 10) to regulate operation of ion trap 606. From approximately 3 ms (when the pressure in ion trap cavity 616 decreases to the low point of approximately 0.18 mTorr) to approximately 15 ms (when the neutral pressure in second chamber 640 is sufficiently low to accept ions 682 (shown in FIG. 10) from ion trap cavity 616), system 600 regulates ions 682 in ion trap cavity 616.

For example, a particular species of ion within ions 682 may be identified for further analysis. The discriminating characteristics for the ions of interest include, without limitation, mass. Firstly, the ion species of interest must be accumulated and isolated from the remainder of ions 682. Each ion species has a characteristic vibration at known frequencies that include oscillations with complex patterns, and these oscillations may be changed through use of complex waveforms, such as waveform 758. One method of accumulating and isolating a particular species is to use a waveform 758 that is particularly effective for the species of interest and substantially solely excite the population of that species. Alternatively, waveform 758, or a plurality of waveforms 758, may be used to excite all of ions 682 with the exception of one particular ion species. Then, the predetermined species may be subsequently excited such that it fragments. Specifically, the identified ions may be illuminated with a CID waveform 760 at a particular frequency such that at least a portion of such ion species are energized such that they break apart to generate fragments through collisional dissociation to facilitate gathering fragment information on a specific ion species. Such collisional dissociation is facilitated by increasing the kinetic energy of the predetermined ion species through absorption of the energy in CID waveform 760 such that they collide with background gas molecules. When the pressure in second chamber 640 is ready to receive ions 682, the ion fragments generated through collisional dissociation are also injected into second chamber 640 from ion trap cavity 616 for analysis.

FIG. 14 is a tabular view, i.e., a table 770 of pressures calculated for QIT-TOF MS system 600 (shown in FIG. 10) during a single pulsed sample and analysis cycle. As such, table 770 summarizes the results for the peak, average, and lowest pressures during a single pulsed sample and analysis cycle. Specifically, table 770 shows that the peak pressure is very high in ion trap cavity 616 (shown in FIG. 10) just after pulsed sample introduction (pulses 680 and 684, both shown in FIG. 10). This is favorable for the ionization process as it enhances the formation of ions 682. In contrast, known MS systems that use continuous sample introduction, but of the same average throughput as the pulsed method would induce the pressures at the average values shown in table 770, which are much too high to perform a MS analysis and therefore such a system would require much higher pumping speed from much larger and costly pumps. In the pulsed method, as disclosed herein, the pressure continues to decay and at the low point the pressures are acceptable for performing the MS analysis, where in the example in table 770, that pressure being 0.021 mTorr.

The above described mass spectrometer (MS) systems enhance detection of materials of interest while reducing the magnitude of the pumping requirements, thereby facilitating decreasing the size, weight, complexity, and costs of MS systems. Specifically, in one embodiment described herein, the associated MS system facilitates separating pulsed pressure waves into two separate components, i.e., a neutral wave including substantially neutral molecules and ionized molecules including substantially ionized molecules. The ionized molecules and the neutral wave are routed through the MS system such that they arrive at the associated detector at different times. As such, the sensitivity of the detectors to the ionized molecules is enhanced, while the detectors are turned off during the arrival of the neutral wave, thereby extending the service life of the detector. Also, specifically, in another embodiment described herein, a pulsed sample is ionized and the ions are trapped while the neutral pressure wave is allowed to decay through the use of the vacuum pumps such that when released from the ion trap, the pulsed ionized molecules are transmitted to the associated detector within the low pressure parameters with a significantly smaller neutral molecule population than would otherwise be transmitted. Additionally, since the significance of the neutral molecules is decreased by temporal and/or physical separation from the ionized molecules, the vacuum pumps associated with the MS systems described herein are decreased in size from those of known MS systems while maintaining the pressures in the systems within established parameters.

A technical effect of the systems and methods described herein includes at least one of: (a) separating a pressure wave introduced into a vacuum chamber of a mass spectrometry system into ionized molecules and a neutral wave separated from each other temporally and physically such that they arrive at a detector separately; and (b) holding a plurality of ionized molecules in an ion trap while a pressure wave mostly made up of neutral molecules decays, thereby facilitating pulsing ionized molecules towards a detector with a significantly reduced neutral population entrained therein.

Exemplary embodiments of mass spectrometer (MS) systems are described above in detail. The methods and systems are not limited to the specific embodiments described herein, but rather, components of systems and/or steps of the methods may be utilized independently and separately from other components and/or steps described herein. For example, the methods may also be used in combination with other detection systems and methods, and are not limited to practice with only the detection systems and methods as described herein. Rather, the exemplary embodiment may be implemented and utilized in connection with many other MS system applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A mass spectrometer system comprising:

a sample injection device defining a sample injection aperture;

an ion trap defining an ion outlet aperture, said ion trap coupled to said sample injection device;

a detector positioned downstream of said ion outlet aperture, wherein the detector is positioned in a detector enclosure defining a detector chamber;

an ion source coupled to said ion trap, said ion source configured to ionize a sample injected into said ion trap and generate a plurality of ionized molecules within said ion trap, said ion trap configured to maintain said plurality of ionized molecules therein while a plurality of neutral molecules migrate out of said ion trap, and into the detector chamber, until a predetermined pressure is attained in said ion trap;

a first vacuum pump coupled to the ion trap wherein the first vacuum pump is configured to decrease a pressure in the ion trap; and a second vacuum pump coupled to the detector chamber wherein the second vacuum pump is configured to decrease a pressure in the detector chamber such that a pressure in the detector chamber induced by the neutral molecules therein decays at a predetermined rate.

2. The mass spectrometer system in accordance with claim 1, wherein said ion source comprises a pulsed vacuum ultraviolet device configured to ionize neutral molecules within said ion trap.

3. The mass spectrometer system in accordance with claim 1, wherein said ion source comprises an ion injection device configured to ionize neutral molecules and inject at least a portion of the ionized molecules into said ion trap.

4. The mass spectrometer system in accordance with claim 1 wherein the first vacuum pump is configured to facilitate decay of the population of neutral molecules within said ion trap.

5. The mass spectrometer system in accordance with claim 1 wherein the detector chamber is coupled to said ion trap through said ion outlet aperture.

6. The mass spectrometer system in accordance with claim 5 wherein an induced pressure in said ion trap is greater than a pressure induced in said detector chamber.

7. The mass spectrometer system in accordance with claim 1, wherein said detector comprises a time-of-flight mass analyzer.

8. The mass spectrometer system in accordance with claim 1, wherein said detector comprises an ion trap mass spectrometer in ion scan out mode.

9. The mass spectrometer system in accordance with claim 1, wherein said ion source comprises an atmospheric pressure ionization (API) device aligned with said ion trap.

10. A method of operating a mass spectrometer system, said method comprising:

channeling a sample into an ion trap;

ionizing at least a portion of the sample, thereby generating a plurality of ionized molecules within the ion trap;

maintaining the plurality of ionized molecules within the ion trap while a plurality of neutral molecules migrate out of the ion trap until a predetermined pressure is attained in the ion trap;

decreasing the pressure in the ion trap through a first vacuum pump;

decreasing a pressure in a detector chamber through a second vacuum pump, wherein the second vacuum pump is configured to decrease the pressure in the detector chamber such that a pressure in the detector chamber induced by the neutral molecules therein decays at a predetermined rate; and transmitting at least a portion of the plurality of ionized molecules from the ion trap into the detector chamber through an ion aperture.

11. The method in accordance with claim 10, wherein ionizing at least a portion of the sample comprises one of:

energizing a pulsed vacuum ultraviolet (VUV) device configured to ionize neutral molecules within the ion trap; and ionizing neutral molecules and injecting at least a portion of the ionized molecules into the ion trap.

12. The method in accordance with claim 11, wherein energizing a pulsed vacuum ultraviolet (VUV) device comprises inducing a containment field through energizing the ion trap within a predetermined portion of the radiofrequency (RF) spectrum after the pulsed VUV is energized, thereby facilitating photoionization, low energy photoemission, and negative ion formation.

13. The method in accordance with claim 11, wherein energizing a pulsed vacuum ultraviolet (VUV) device comprises inducing a containment field through energizing the ion trap within a predetermined portion of the radiofrequency (RF) spectrum before the pulsed VUV is energized, thereby facilitating electron ionization, high energy photoemission, and positive ion formation.

14. The method in accordance with claim 10, wherein channeling a sample into the ion trap comprises injecting a plurality of molecules into the ion trap through a plurality of pulses.

15. The method in accordance with claim 10 wherein the pressure in the ion trap is greater than the pressure in the detector chamber.

* * * * *